US007053875B2

(12) United States Patent
Chou

(10) Patent No.: US 7,053,875 B2
(45) Date of Patent: May 30, 2006

(54) LIGHT EMITTING DEVICE DISPLAY CIRCUIT AND DRIVE METHOD THEREOF

(76) Inventor: Chen-Jean Chou, 21 Ridgefield Rd., New City, NY (US) 10956

( * ) Notice: Subject to any disclaimer, the term of this patent is extended or adjusted under 35 U.S.C. 154(b) by 0 days.

(21) Appl. No.: 11/161,887

(22) Filed: Aug. 20, 2005

(65) Prior Publication Data

US 2006/0038762 A1 Feb. 23, 2006

Related U.S. Application Data

(60) Provisional application No. 60/522,151, filed on Aug. 21, 2004.

(51) Int. Cl.
*G09G 3/36* (2006.01)

(52) U.S. Cl. ..... 345/92; 345/82; 345/76; 345/214

(58) Field of Classification Search ..... None
See application file for complete search history.

(56) References Cited

U.S. PATENT DOCUMENTS

| | | | | |
|---|---|---|---|---|
| 5,408,109 | A | 4/1995 | Heeger et al. | 257/40 |
| 5,482,896 | A | 1/1996 | Tang | 438/28 |
| 5,663,573 | A | 9/1997 | Epstein et al. | 257/40 |
| 5,684,365 | A | 11/1997 | Tang et al. | 315/169 |
| 5,952,789 | A | 9/1999 | Stewart et al. | 315/169 |
| 6,157,356 | A | 12/2000 | Troutman | 345/28 |
| 6,501,466 | B1 | 12/2002 | Yamagishi et al. | 345/28 |
| 6,580,408 | B1 | 6/2003 | Bae et al. | 345/76 |
| 6,618,030 | B1 | 9/2003 | Kane et al. | 345/82 |
| 6,621,100 | B1 | 9/2003 | Epstein et al. | 257/40 |
| 6,686,699 | B1 | 2/2004 | Yumoto | 315/169 |
| 6,734,636 | B1 | 5/2004 | Sanford et al. | 315/169 |
| 2005/0024351 | A1* | 2/2005 | Sano | 345/204 |

* cited by examiner

*Primary Examiner*—Tuyet Thi Vo

(57) ABSTRACT

Multiple conducting channels in a display pixel, controlled by a single access electrode are provided in the present invention. Such pixel circuits operate to set a pixel data voltage by directing a data current to one of the conducting channels, while deliver a drive current to the light emitting device in a pixel via the other conducting channel. Current-controlled drive scheme, independent of threshold voltage, is achievable in the present invention without substantial increase in pixel complexity. Such merged pixel structures provide simplicity and greater flexibility in implementing current drive pixel structure.

28 Claims, 14 Drawing Sheets

100

LIGHT EMITTING DEVICE DISPLAY CIRCUIT AND DRIVE METHOD THEREOF

CROSS REFERENCE

The present application claims priority of U.S. Provisional Patent Application No. 60/522,151, filed on Aug. 21, 2004, which is hereby incorporated by reference.

BACKGROUND OF THE INVENTION

1. Field of the Invention

The present invention relates to the pixel circuits and drive method of an active matrix display comprising light-emitting devices which emits light by conducting a driving current through a light emitting material such as an organic semiconductor thin film. Such pixel circuits comprise active elements, such as thin film transistors, for controlling the light emitting operation of the respective light emitting devices. More specifically, the present invention provides pixel circuits comprising a multi-functional control electrode and a method to operate such pixel circuits. Furthermore, pixel circuits in the present invention are structured with alternating conducting channels, controlled by said multi-functional control electrodes. Pixel circuits capable of performing current-controlled drive scheme, with reduced complexity than existing solutions, are provided as preferred application of the present invention.

2. Description of the Prior Art

Organic light emitting diode displays have attracted significant interests in commercial application in recent years. Its excellent form factor, fast response time, lighter weight, low operating voltage, and prints-like image quality make it the ideal display devices for a wide range of application from cell phone screen to large screen TV. Passive OLED displays, with relatively low resolution, have already been integrated into commercial cell phone products. Next generation devices with higher resolution and higher performance using active matrix OLEDs are being developed. Initial introduction of active matrix OLED displays have been seen in such products as digital camera and small video devices. Demonstration of OLED displays in large screen sizes further propels the development of a commercially viable active matrix OLED technology. The major challenges in achieving such a commercialization include (1) improving the material and device operating life, and (2) reducing device variation across the display area. Several methods have been suggested to address the second issue by including more active switching devices in individual pixels, or by switching of supply lines externally. As more elaborated control circuits being incorporated into individual pixels in these solutions, an inevitable consequence is an increase of device complexity.

An OLED display differs from a liquid crystal display (LCD) in that each and every pixel in an OLED display produces light output. The light output from a pixel is more conveniently controlled by the current directed to the pixel. An LCD, in contrast, is readily controlled by the voltage signals as its optical properties directly respond to the applied voltage. While a typical storage device holds voltage information, operating an active matrix OLED display via a typical storage element requires an additional transfer method to convert a stored voltage data into specific current output. A practical conversion method needs to be reliable and fairly independent of such factors as pixel-to-pixel variation in the characteristics that affect said conversion, to make an OLED display operable in good uniformity.

Basic examples of using organic material to form an LED are found in U.S. Pat. No. 5,482,896, U.S. Pat. No. 5,408,109 and U.S. Pat. No. 5,663,573, and examples of using organic light emitting diode to form active matrix display devices are found in U.S. Pat. No. 5,684,365 and U.S. Pat. No. 6,157,356, all of which are hereby incorporated by reference.

An active matrix OLED display (FIG. 1) is typically structured with "SELECT" electrodes for row select, "DATA" electrodes for setting the pixel state, power electrodes VDD to drive the pixels, and a reference voltage VREF to provide a common voltage level. A basic pixel in an active matrix display also comprises at least one transistor for data control, and at least a storage element to hold the data information sufficiently long so a pixel remains stable in a data state in an image frame. A circuit diagram for a basic pixel 100 in an active matrix OLED display is depicted in FIG. 2 in further detail. An active matrix with pixel circuit structured similar to FIG. 2 allows data to be written and retained in a storage capacitor 204 according to the data signal delivered from a data electrode in an address cycle, while the power supply VDD continuously drives OLED 205 through an n-channel transistor 201, according to the data setting in capacitor 204. The selection of pixels to receive data information is controlled by an n-channel transistor 203 that is controlled by the voltage on a select electrode connected to the gate of transistor 203. An active matrix driving scheme allows the drive transistor 201 remain in a data state, and continue to deliver the required drive current, for an extended period of time after the input data on the data electrode is disconnected from the pixel. The peak current required for achieving a certain brightness level is thus reduced accordingly compared to a passive matrix. The peak driving current in an active matrix display does not scale with the resolution as in a passive matrix, making it suitable for high resolution applications. Stability of the active matrix display is also improved appreciably.

As illustrated in the above example, the electrical current for producing light output flows through at least a control element that regulates the current. In a conventional light emitting device display, these control elements are fabricated on a thin film of amorphous silicon on glass. Power consumed in such control elements are converted to heat rather than yielding any light. To reduce such power consumption, polycrystalline silicon is preferred over amorphous silicon for its better mobility. More elaborated methods employing self-regulated multiple-stage conversions suitable for pixel circuit using polysilicon base material may be found in U.S. Pat. No. 6,501,466 and U.S. Pat. No. 6,580,408. These methods provide a current drive scheme while largely eliminated the impact from material and transistor non-uniformity typically associated with thin film polysilicon on glass. In these methods, typically a minimum of four transistors are required to achieve such self-regulated, multi-stage conversion to achieve a pixel-independent current drive for the display. An example of such methods is illustrated in FIG. 3. where four transistors 301, 302, 303, and 307, and 3 access lines, DATA, SELECT, and VDD, are used for each pixel with a storage capacitor 304 and an OLED 305.

The circuit in FIG. 4 illustrates another method for a self-regulating current drive scheme. The display circuit includes a switch on the power supply electrode, switching the source voltage between two voltage levels VDD1 and VDD2. Comparing to the example of FIG. 3, the transistor count of FIG. 4 is less than that of FIG. 3, but an additional access electrode with switching capability is required to operate the pixel and to deliver drive current to the light emitting diode in a current drive scheme.

FIG. 5 illustrates another method that reads the pixel parameters into an external processing circuit that comprises memory and adjustment circuitry. The variations of pixel parameters, such as the threshold voltage variation, mat be eliminated by such external adjustment. The pixel circuit comprises five transistors and five access electrodes.

These examples of prior art provide a brief overview of the existing solutions considered in the art to resolve the uniformity issue. Comparing to the basic pixel circuit in FIG. 2, it is evident that any current solution to the uniformity issue involves a substantial increase in the complexity of pixel circuit, and thus likelihood of reduction of available light emitting area, efficiency, and product yield.

The present invention provides a multi-functional scan-power electrode for pixel access that carries the conventional pixel select function and power delivery function on the same bus line, thereby allowing a reduction in display complexity. The present invention further provide multiple conducting channels in a pixel, for setting the data voltage and delivering data current. The pixel structure so constructed comprises a direct current path from scan-power electrode to the light emitting element and a direct current path form data electrode to the reference voltage source. The turning-on and off of such channels are fully controlled by the voltage applied on a scan-power electrode.

The present invention addresses the complexity issue by structuring a pixel so that a conventional scanning electrode is configured as a current supply electrode to the light emitting device in part of a cycle to deliver full drive power, without adding to the circuit any additional switching electrode or signals. Furthermore, structures comprising multiple conducting channels controlled by a single scan-power electrode allow an operation in current drive mode with simplicity.

SUMMARY OF THE INVENTION

The present invention provides pixel circuits and a drive method to operate said pixel circuits, where a pixel circuit is constructed with a multi-functional scan-power electrode that selects pixels for data input in a scanning period and operates as current supply electrode to deliver drive current to the light emitting element in the drive period of display operation. Furthermore, a pixel circuit in the present invention comprises two alternating conducting channels, one between a data electrode and a reference voltage source, and the other between a scan-power electrode and said reference voltage source via said light emitting element.

Preferred embodiments of the present invention are provided for operating a display in current drive scheme to eliminate dependency on threshold voltage variation and OLED characteristics. The present invention also utilizes a drive method that merges conventional power delivering electrode and scanning electrode into a single access electrode (scan-power electrode). Preferred embodiments in three-transistor implementation are provided to illustrate the application to the solutions for current drive scheme within the present invention. Additional embodiments are provided as illustration of a broader implementation principle.

Additional features and advantages of the present invention will be set forth in the description which follows, or may be learned by practice of the invention. The objectives and other advantages of the invention will be realized and attained by the structure particularly pointed out in the written description and claims hereof as well as the drawings.

BRIEF DESCRIPTION OF THE DRAWINGS

FIG. 7 is a schematic diagram of a pixel circuit in an alternate embodiment of the present invention with.

DETAILED DESCRIPTION OF THE INVENTION

Figure 1:
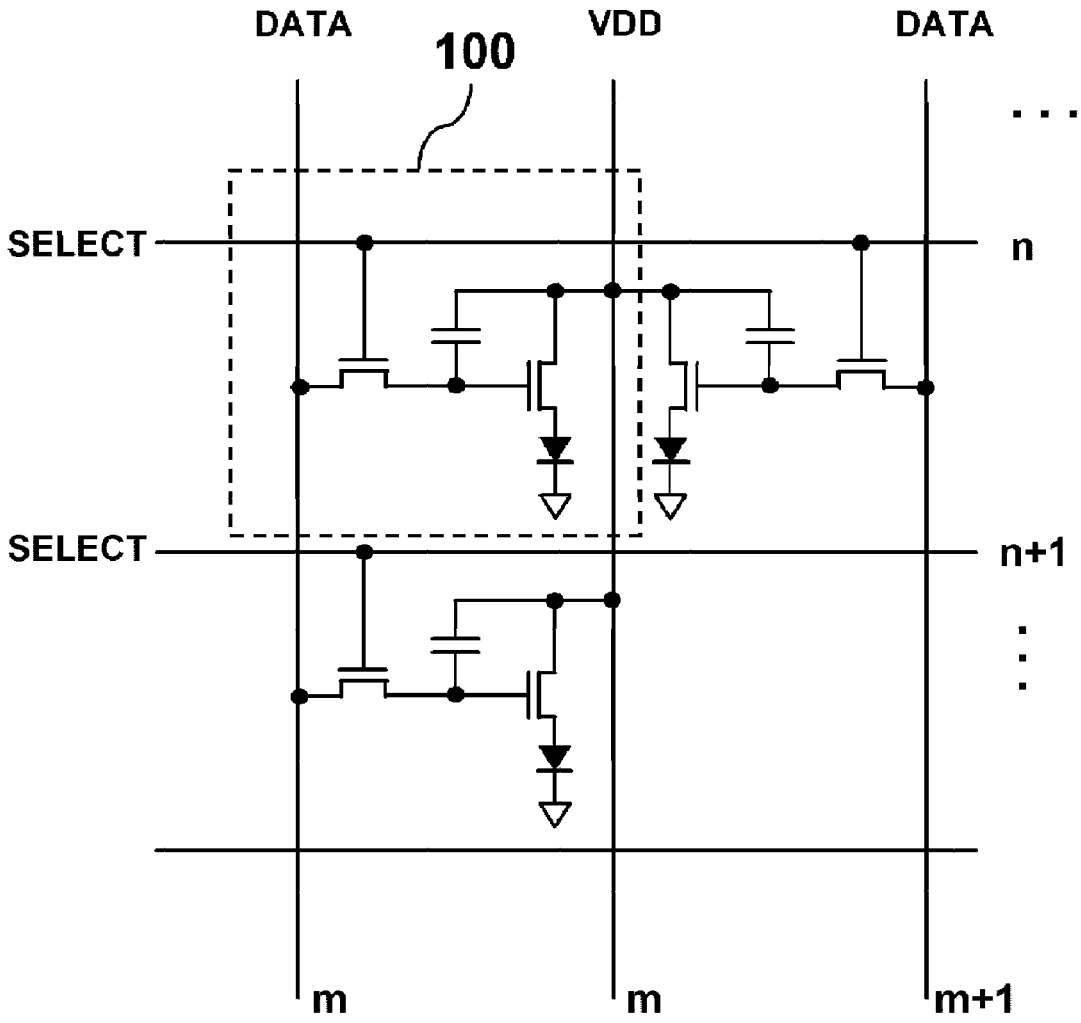
Fig. 1 (Prior Art)
FIG. 1 is a schematic of a prior art active matrix light emitting device display.
Figure 2:
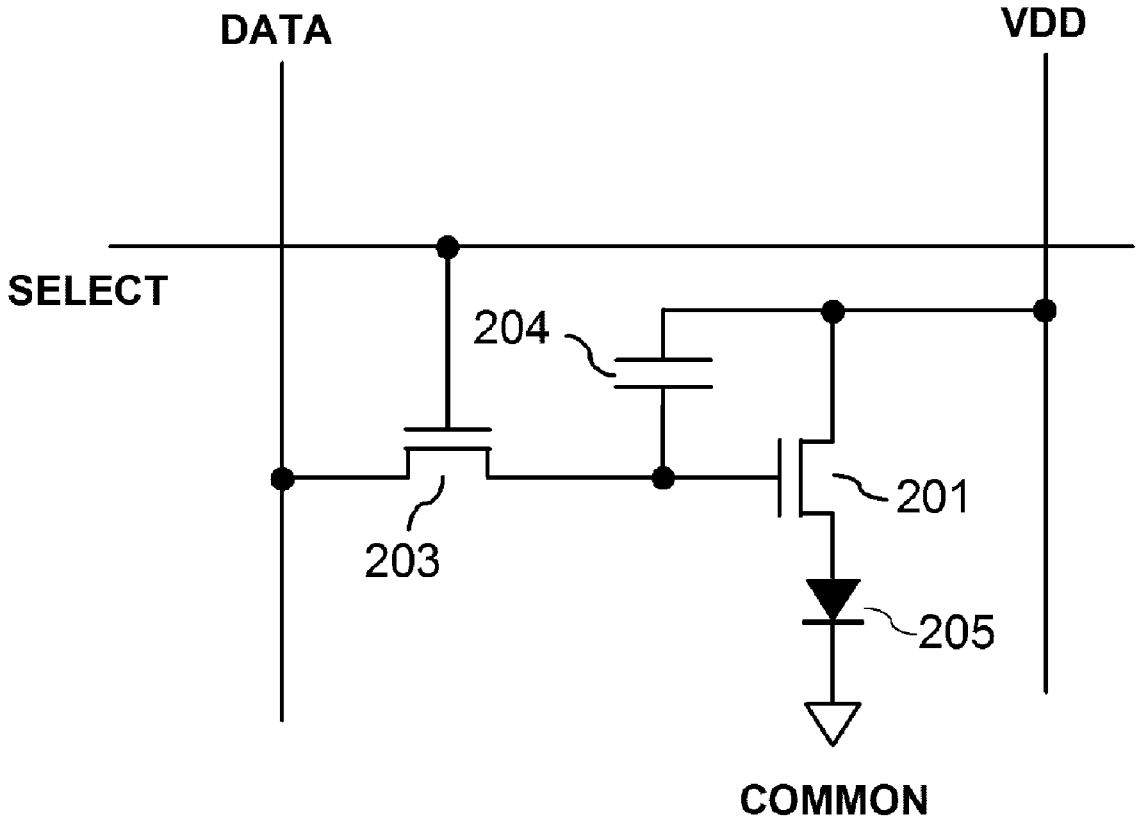
Fig. 2 (Prior Art)
FIG. 2 is a schematic of a prior art pixel circuit in an active matrix light emitting device.

This invention and the claimed subjects therein are directed to operating a display containing light emitting elements.

The present invention provides active matrix pixel circuits and a method to drive such. The circuit comprises two conducting channels in a pixel, enabled alternately by the signals applied to the same control electrode. Preferred embodiments of the present invention are provided for the current drive scheme to eliminate dependency on threshold voltage variation and OLED characteristics. The present invention also utilizes a drive method that merges conventional power delivering electrode and scanning electrode into a single access electrode (scan-power). Preferred embodiments in three transistor implementation are provided to illustrate the simplicity of the solutions for current drive scheme within the present invention. Additional embodiments are provided as illustration of the implementation principle.

Preferred embodiments of the present invention are herein described using organic light emitting diodes as illustration. Examples of using organic material to form an LED are found in U.S. Pat. No. 5,482,896 and U.S. Pat. No. 5,408,109, and examples of using organic light emitting diode to form active matrix display devices are found in U.S. Pat. No. 5,684,365 and U.S. Pat. No. 6,157,356, all of which are hereby incorporated by reference.

As evidenced in the prior art, the conventional method of constructing and operating a light emitting device display involves a scanning electrode (or referred to as SELECT line, GATE line, or other names carrying similar meaning) and a power supply electrode (VDD). The scanning electrode interacts with a pixel through high impedance gates of switching elements in the pixel and does not participate in delivering drive current to the light emitting device.

The present invention provides a method to drive light emitting device in an active matrix display without explicit power electrodes. The same electrode that selects a pixel for data writing delivers a full amount of drive current in a subsequent operating period. A pixel so constructed utilizes a scan-power electrode that delivers drive current while inhibiting data transfer between said data electrode and said pixel in one period, and enables data writing from data electrode into said pixel according a scanning signal in another period. A pixel so constructed comprises a conducting channel (now referred to as SP) between a scan-power electrode and the voltage source that supplies the drive power to the light emitting device in a the pixel. The enabling and inhibiting of conducting channel SP are fully controlled by voltage signals applied to the scan-power electrode.

Furthermore, a pixel in the present invention comprises a conducting channel (now referred to as DP) between a data electrode and the said voltage source. The conducting channel DP is enabled and inhibited according to the voltage applied to said scan-power electrode.

The channel SP is also referred to as the second conducting channel, and channel DP is referred to as the first conducting channel.

In the description of this invention, a direct current path is a current path not interrupted by or ended on a capacitor; it may comprise such elements as resistor, drain-to-source and emitter-to-collector of a transistor, anode-to-cathode of a diode, and conductive lines that allow a constant current to continue. A direct current path in this description also implies that it is enabled and conducts intended current in at least one of the operation periods for operating a display device. A charging current ended on or via a capacitor does not constitute a direct current path. Transient currents arising from charging of input gate or parasitic capacitors are not considered as providing valid current path. The reverse leakage of a diode, the leakage current in a transistor in its off-state, and current via the high impedance input terminals (such as a base or a gate) are also not considered as valid current paths. In this sense, a direct current path in this description is a current path that allows the conduction of an intended current for the purpose of operating a display pixel, and allows such current to continue for as long as the set conditions remain.

A scan-power electrode represents an access line that is structured to perform both a scanning operation where a scanning signal is delivered to enable data input in selected pixels in one period of the operation, and a drive operation where a drive current is delivered to a light emitting device in another period of operation. A scanning electrode means a conventional access line that performs a conventional scanning (or select) operation only. A scanning (or data writing) cycle is a period that a pixel is selected to allow data to be transferred from a data electrode into the selected pixel. The transferred data information is stored in a storage element in the pixel.

An organic light emitting diode (OLED) is used in most preferred embodiments wherever appropriate; the presence of such a device in such examples should not be construed as setting forth a limitation on the present invention directed for light emitting devices in general. The MOS devices are used as a preferred embodiment for the switching elements. Similar bipolar transistors perform equal functions as MOS devices. Those skilled in the art can quickly derive variations by a substitution of an arbitrary light emitting device for the organic light emitting diode therein. It is also well recognized that the preferred operation condition and preferred data format do not constitute a limitation on operating these circuits.

Preferred embodiments of the present invention will hereinafter be described in detail with reference to the drawings.

Figure 6:
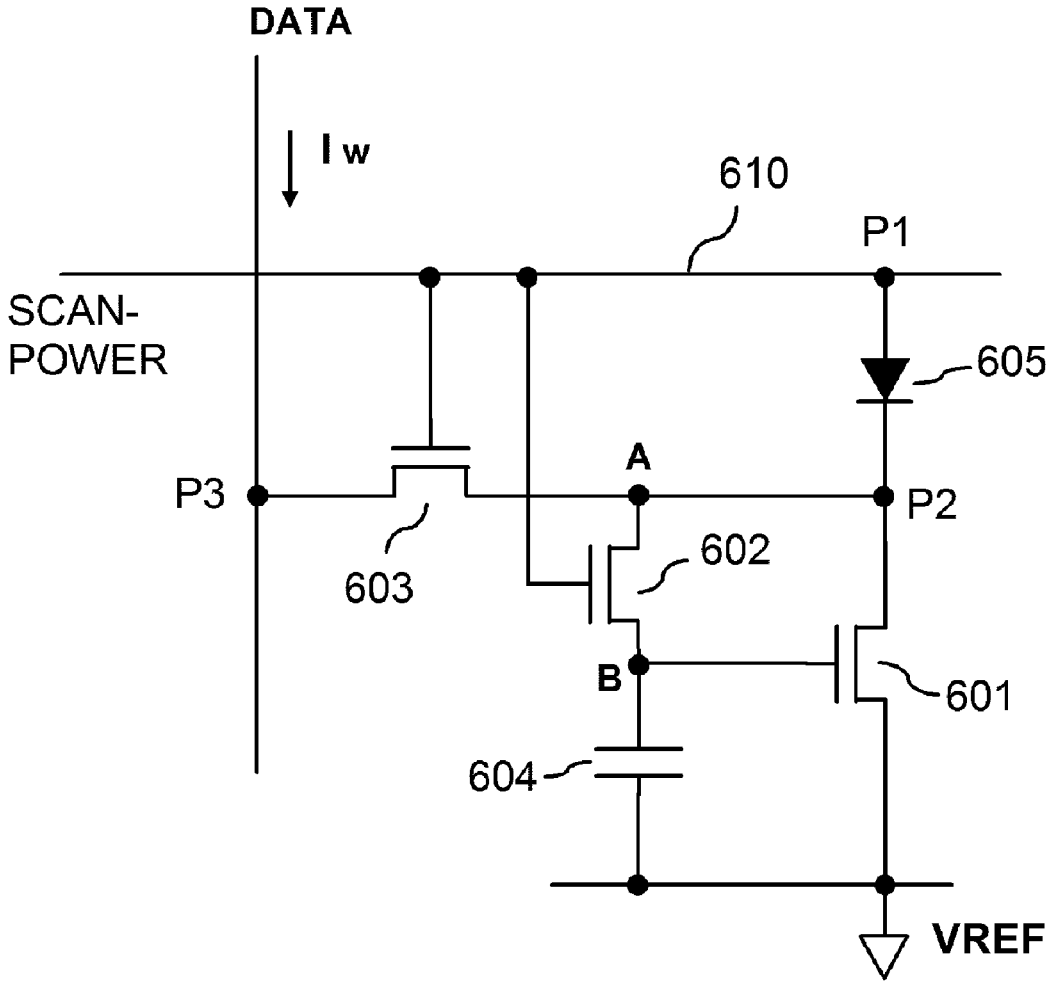
FIG. 6 is a schematic diagram of a pixel circuit in a three-transistor embodiment of the present invention.

A pixel circuit of a preferred embodiment in the present invention is provided in FIG. 6, comprising a first transistor 601, a second transistor 602, a third transistor 603, OLED 605, storage capacitor 604, and a common reference voltage source VREF. A preferred implementation of FIG. 6 has two p-channel transistors 602 and 603 for data control, and an n-channel transistor 601 for drive, Referring to FIG. 6, in a preferred mode of operation, data information is formatted in the form of current source $I_W$. A preferred mode of operation of this embodiment is described hereinafter:

1. Data signal and desired output. When a current is conducted in an OLED, the light output of the OLED is conveniently considered linear to the drive current. In order to maintain a uniform control of light output insensitive to the variation from pixel to pixel, it is highly desirable to devise a pixel circuit that provides a transfer function converting input signal from a data electrode linearly into output current on OLED. Such a transfer function needs to be independent of variation of major parameters in a pixel circuit such as threshold voltage of the control transistors and OLED forward voltage. It is recognized in the art that such a site-independent transfer may be better accomplished by using data signals in the form of current source, as illustrated in prior art. Accordingly, the discussion here focuses on the operation using current source $I_W$ delivered on a data electrode to produce a current output $I_D$ on an OLED. For example, in a preferred format, any data information is fromatted in the form of a data current, where the data current is proportional to the brightness of the corresponding data point of the information to be displayed. For example, to display an image in 64 levels of gray scales, each increment in the gray scale corresponds to 1/(64−1) of the maximum current that corresponds to the full brightness level. A preferred circuit and its operation are expected to produce an output current in a drive cycle that is converted linearly from the input data current in a scan cycle.

2. Scan and data writing cycle. A scanning voltage signal $V_{LO}$ is applied to a scan-power electrode 610, where $V_{LO}$ is equal to or slightly below VREF, and is set to be the lowest potential in the operation of a display system. Accordingly, having the voltage low $V_{LO}$ applied to their gates via the scan-power electrode, both p-channel transistors 603 and 602 are turned on. Transistors 603 and 602 remain in their on-states in the scan cycle when $V_{LO}$ remains on the scan-power electrode. Through the scan-power electrode 610, said scanning voltage $V_{LO}$ is also applied to the anode of light emitting device 605, biasing the light emitting diode 605 in reverse direction, thereby inhibiting a diode current. Setting the scanning voltage $V_{LO}$ to be the lowest operating voltage in the system ensures that a) the two p-channel transistors 602 and 603 are turned on in the scanning period, and b) LED 605 remains zero or reverse biased, regardless of what other conditions may vary. The data encoded in $I_W$ in this example may take various functional dependences on the output current. A preferred functional dependence for illustration is a linear dependence, that is, $I_W$ is encoded to be linearly proportional to the expected output current. As p-channel transistors 603 and 602 being turned on, current $I_W$ is directed toward capacitor 604, charging up capacitor 604, thereby raising the voltage (Vc) of the capacitor. As the voltage of the capacitor reaching above the threshold voltage of 601, transistor 601 turns on, opening a current path through 601. Since the capacitor is connected to the gate, any increase in the voltage of capacitor 604 is directly applied to the gate of transistor 601, and further increase the current in NMOS 601, thereby accelerating the system to reach towards its steady state. As the pixel approaches its final state, charging current of capacitor 604, via 602, diminishes to zero and the source "A" and drain "B" terminals of 602 are approaching the same voltage. This ensures that the gate (connected to the drain of 602) of NMOS 601 and the drain of 601 (connected to the source terminal of 602) are at the same potential, and provides:

$$V_{GS}=V_{DS} \tag{1}$$

According to the characteristics of MOS transistors, this bias voltage ensures that 601 is in saturation region and the current ($I_D$) through 601 is control by the gate voltage according to a formula:

$$I_D=C_1(V_{GS}-V_{TH})^2 \tag{2}$$

where $V_G$ is the gate voltage of transistor 601, $V_{TH}$ is the threshold voltage of 601, and $C_1$ is a constant determined by the width, length, and intrinsic parameters such as the mobility of silicon, the thickness and dielectric constant of the gate oxide of transistor 601. Approaching the end of a scan cycle, the current branched into the capacitor diminishes to zero, and all current paths in the pixel, except the one via transistor 601, are terminated. The entire data current is thus forced through transistor 601, thereby giving $$I_D=I_W \tag{3}$$

3. Drive cycle. After data is written into a pixel and the capacitor 604 charged to a voltage $V_{GS}$ that sets transistor 601 in saturation region, electrode 610 is set to a voltage high ($V_{HI}$) sufficient to provide a full forward bias on LED 605, and to keep transistor 601 in its saturation region. A preferred voltage high ($V_{HI}$) is typically equal to, or higher than the sum of the maximum LED forward operating voltage and the maximum voltage on a data electrode output. For a pixel comprising an OLED operating in 7.5 volt range, a typical NMOS TFT, and a dynamic data range of 3 volts, a preferred voltage high is in the range of 11–13 volts above VREF. Such a condition for $V_{DD}$ ensures that the voltage drop $V_{DS}$ across the drain and source of transistor 601, in a drive cycle, is higher than the written voltage $V_{GS}$ stored in the capacitor 604 from a scan cycle, thereby forcing transistor 601 into its saturation region. As electrode 610 being set high, the two p-channel transistors 603 and 602 are turned off, thereby completely isolating capacitor 604 from the external data electrode and from the drain node of transistor 601. The charge accumulated in capacitor 604 from the scan cycle is thereby retained for as long as the parasitic leakage current permits. Meanwhile, LED 605 becomes forward biased as its anode being at a positive potential relative to VREF. With the condition provided above for $V_{DD}$, and an I-V analysis of the operating conditions for a transistor, it can be verified that $V_{DS} \geqq V_{GS}$ in the drive cycle. The transistor 601 therefore remains in the saturation mode, and ID is given by a similar formula as above:

$$I_D=C_2(V_{GS}-V_{TH})^2 \tag{4}$$

Since $C_2$ is determined by the same set of parameters of the same transistor 601, a relation $C_2=C_1$ is a fairly close approximation, resulting in $I_D=I_W$. This operation therefore delivers an output current in the drive cycle that is equal to the input data current $I_W$.

The operation described hereinabove illustrates a current drive mode utilizing a preferred embodiment of the present invention. In such current drive mode, an input data is delivered in the form of a current. This input current is first converted into a data voltage in the data-to-VREF conducting channel, then converted by the drive transistor to a output current linear to the input current. As a whole, the control circuit in the pixel converts an input current into an output current for driving the light emitting device in the pixel. The conversion in this preferred operation is a linear conversion. For a light emitting device whose light output is linearly dependent on its current, the operation illustrated here provides a linear control of light output by the input current alone. This preferred embodiment and operation thus provide a solution to the current drive mode for light emitting deices, where the influences from the OLED's characteristics and the threshold voltage of drive transistor are eliminated.

It should be noted that the linearity between the input and output is a preferred mode of operation, not a required condition to operate this invention. It should also be noted that the condition $C_2=C_1$ is a preferred implementation of this embodiment, not a necessary condition to provide a linear transfer. Typically, a small increase of $C_2$ from $C_1$ is expected as $V_{DS}$ in a drive cycle increases and drifts further into saturation from the on-set point of saturation on the current-voltage curve where $V_{DS}$ is equal to $V_{GS}$, and where such voltage is taken as the data voltage in a scanning cycle and stored in the capacitor. This increase is typical due to the modulation of channel length, high field feedback from the drain node, and the backchannel conduction in a thin-film transistor. In drive operation, $V_{DS}$ is equal to $V_{GS}$ when the input data approaches the maximum of the data range, and is slightly greater than $V_{GS}$ otherwise.

From the operation described hereinabove, the preferred embodiment of FIG. 6 illustrates a scan-power electrode 610 that enables and inhibits data input according to the signals applied to it, and that delivers drive current to the light emitting diode.

The drive current to operate the light emitting element in this embodiment is the current directed to the conducting channel between scan-power electrode 610 and the reference voltage source VREF. This drive current is directed to the light emitting element 605 via the drive transistor 601, and is regulated by the gate voltage of 601, where the gate voltage of transistor 601 is the same as the data voltage help at capacitor 604.

The preferred embodiment of FIG. 6 further illustrates a first conducting channel DP between a data electrode and the reference voltage source VREF (from P3, to A, to P2, to VREF), and a second conducting channel SP between a scan-power electrode and the reference voltage source VREF (from P1, to P2, to VREF). Conducting channel DP is enabled in a scanning period, conducting a data current from the data electrode to VREF and setting the voltage of storage capacitor according to a data current $I_D$.

The preferred embodiment of FIG. 6 further illustrates that the conducting channel SP conducts an intended drive current directed to drive the light emitting diode to emit light during a drive cycle, and that the conducting channel DP conducts an intended data current directed for setting a data voltage at the storage capacitor during a data writing (scanning) cycle.

By applying a specific set of signals as described in this preferred mode of operation, conducting channel SP is enabled while conducting channel DP is inhibited in a drive cycle. Channel DP is enabled while channel SP is inhibited in a scanning (data) cycle.

In this preferred mode of operation, it is illustrated that said conducting channel DP converts an input data current $I_D$ into a voltage for the capacitor 604, and stored in said capacitor.

More specifically, a voltage is generated at the drain terminal of transistor 601 by directing a data current ID through conducting channel DP via transistor 601; the same voltage is produced at the gate terminal of said transistor 601, as transistor 602 is fully turned on in a scanning period and have no steady-state voltage drop across it. Such operation thus converts a data current into a data voltage at the gate of transistor 601 for storage. More specifically, the voltage being stored in this preferred embodiment is the voltage produced between a gate terminal and a source terminal, and which is provided for said capacitor.

An active matrix display can be constructed from the pixel unit provided in this embodiment by forming such pixels at intersects between a plurality of data electrodes and a plurality of scan-power electrodes. As an example for a complete display unit, a current driver unit with matching number of output terminals is attached to the edge of such matrix display where each data electrode is connected to an output terminal of the data driver unit to provide data current signal. A scan-power driver is attached to another edge of such display matrix where each scan-power electrode is connected to an output terminal of the scan-power driver unit to receive scanning pulses and driver current.

In a preferred implementation of the embodiment of FIG. 6, the transistors are thin film transistors (TFT) formed on a layer of amorphous or polycrystalline silicon on a transparent glass substrate. The transistors may also be form on single crystal silicon substrate, and may be either MOS or bipolar device. The common reference voltage source is typically supplied through a continuous layer 670 of conductive material connected to each and every pixel. The organic light emitting diode may be formed with a stack of layers of small-molecule or polymer organic materials. Such light emitting structure typically comprises a cathode layer, an electron-transport layer, a hole-transport layer, and an anode layer. An additional emitter layer is often provided between the electron-transport and the hole-transport layers to enhance the light producing efficiency. The data and scan-power electrodes are typically formed by first depositing or coating a layer or layers of conductive materials, and followed by a standard photolithography and etch processing techniques to define the pattern of such electrodes. In a preferred implementation, the storage element is a parallel-plate capacitor formed by sequentially preparing a first conduct layer, an insulating layer, and a second conductive layer, followed by a standard photolithography and etch processing to define a capacitor structure. A preferred method typically used to connect various device structures in a display circuit, such as the one presented in FIG. 6 of this invention, is by defining the device pattern and contact points with a photolithography and etch process. Various techniques used to produce the structures and connections needed for the implementation of the circuit in FIG. 6 are available in the art, and the examples of which are found in the documents incorporated by reference.

The storage element in this preferred embodiment may be also constructed as part of a gate structure where the gate electrode of transistor 601 overlaps the source region of transistor 601. The source region, typically heavily doped N- or P-type silicon acts as the bottom electrode of the capacitor, and the gate electrode acts as the top electrode. The gate oxide constitutes the insulation layer for the capacitor. Such a gate-to-source capacitor may be explicitly fabricated, or as part of inherent or parasitic capacitive element.

Figure 7:
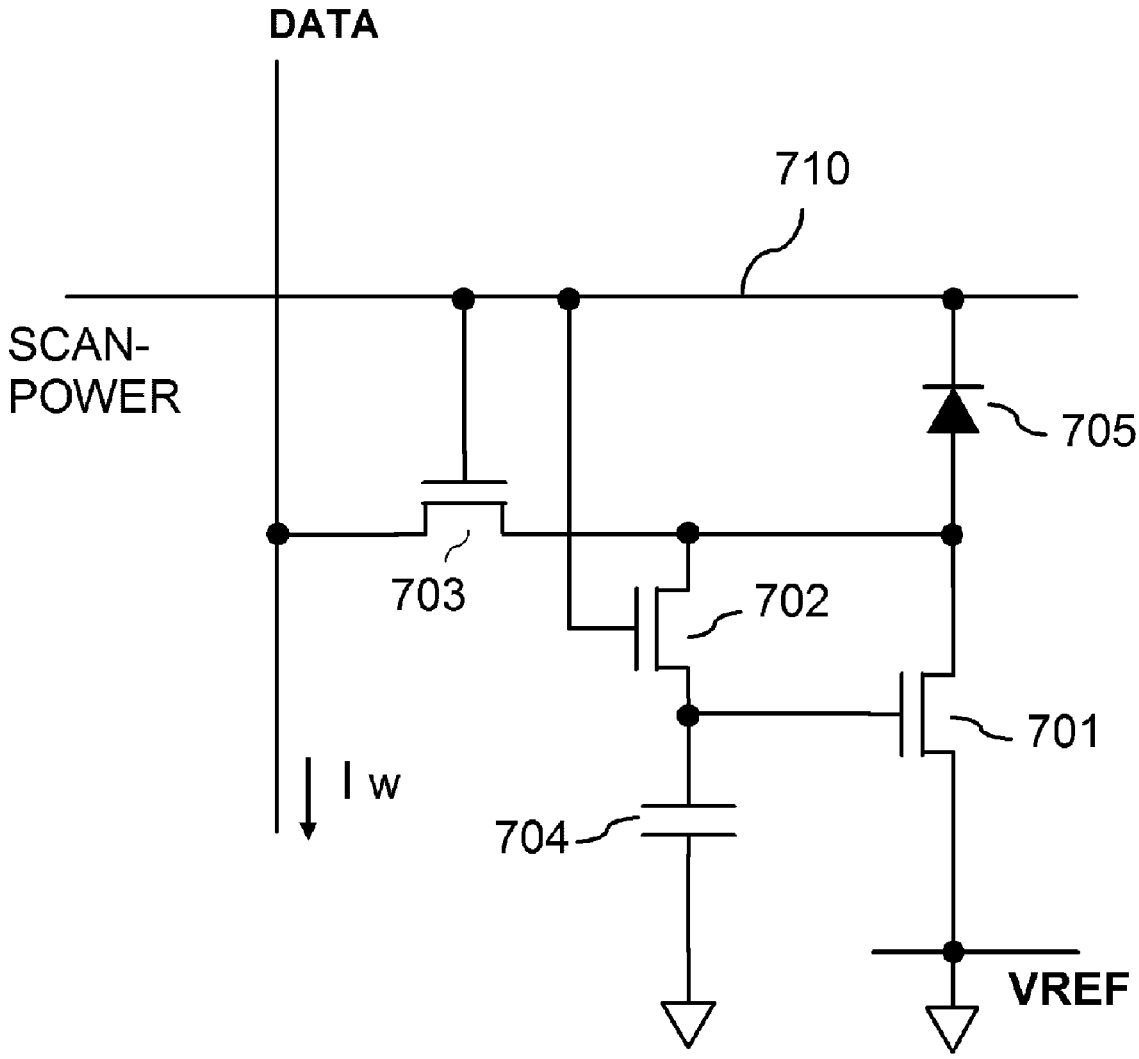

A variation of the circuit in FIG. 6 is illustrated in another preferred embodiment in FIG. 7, wherein a common cathode structure is implemented. The pixel circuit in FIG. 7 utilizes two n-channel transistors 703 and 702 for data control, a p-channel drive transistor 701, a storage capacitor 704, and OLED 705. In a preferred operation, VREF is set to be the same as the voltage high in the system. Scanning cycle for writing data is initiated by setting a voltage high on a scan-power electrode 710, and driving power is enabled by setting a voltage low $V_{LO}$ on the scan-power electrode; wherein voltage high is equal to or slightly higher than VREF, $V_{LO}$ is below VREF by a value approximately equal to the sum of maximum data voltage and maximum OLED forward voltage. The procedure of operation and transfer function is similar to that of the circuit in FIG. 6, except that the polarity regarding high and low is reversed in the present embodiment. This embodiment similarly illustrates a first conducting channel from data to VREF, a second conducting channel from the scan-power electrode to VREF via OLED 705, the enabling and disabling of these conducting channels by the scan-power electrode, the setting of capacitor voltage, and the delivery of drive current, as in the embodiment of FIG. 6.

Figure 8:
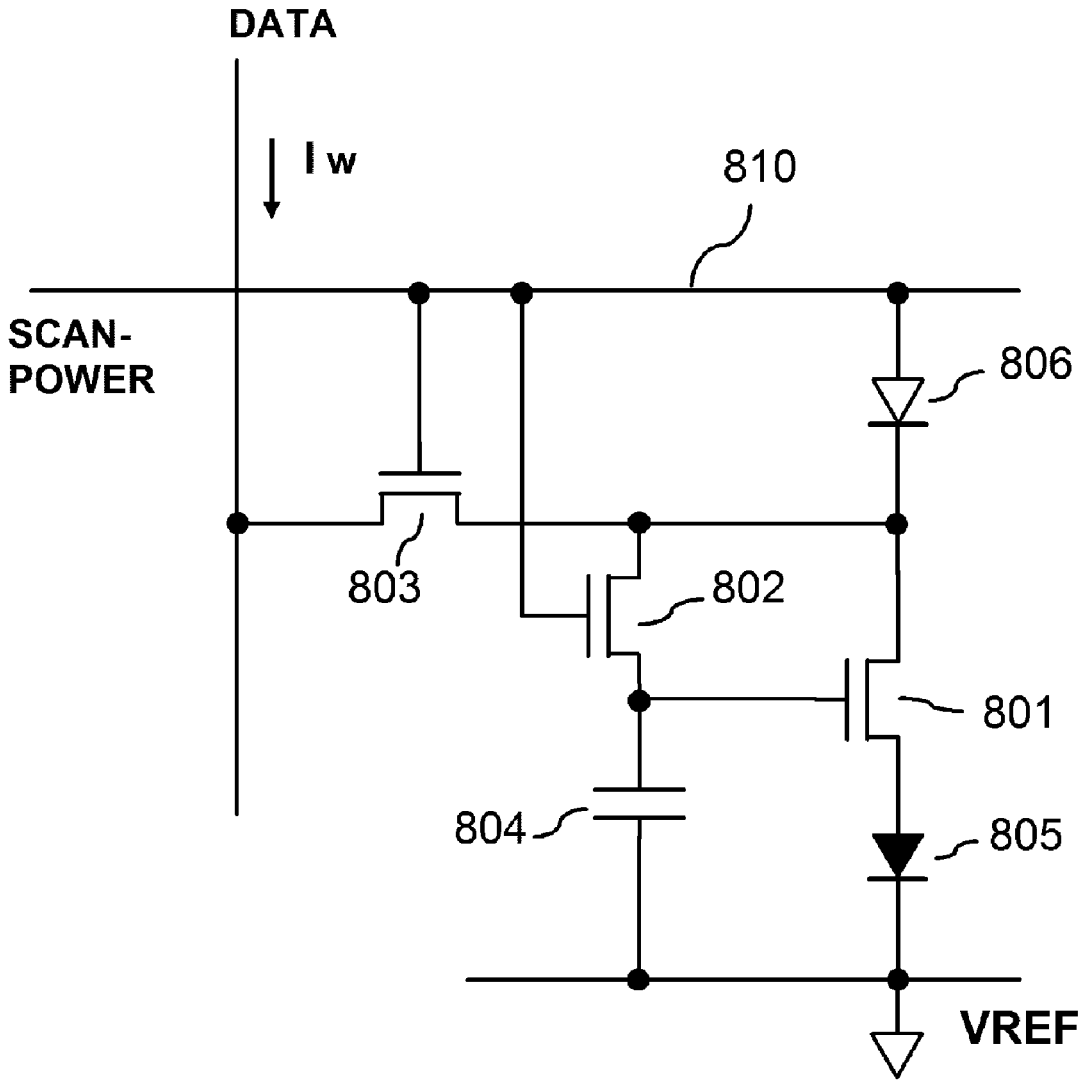
FIG. 8 is a schematic diagram of a pixel circuit in an alternate embodiment of the present invention with an additional blocking diode.

An extension of FIG. 6 is given by another preferred embodiment in FIG. 8, where an additional diode 806 is included. In a preferred implementation, a pixel circuit comprises two p-channel transistors 803 and 802, an n-channel transistor 801, storage capacitor 804, and OLED 805. During a scanning (write) cycle, a voltage low is applied to scan-power electrode 810, turning on p-channel transistors 803 and 802, and allowing data to be refreshed at the capacitor and gate of 801. A voltage low on electrode 810 simultaneously puts diode 806 in reverse bias, thereby blocking any current flow into electrode 810 through the diode. In drive cycle, a voltage high is applied on electrode 810, turning off transistor 803 and 802, and forward biasing diode 806 and n-channel transistor 801, thereby delivering drive current according to the voltage set on the gate of transistor 801. This embodiment similarly provides the two conducting channels operated by applying control signals on the scan-power electrode, setting data voltage by the data-to-VREF channel, and driving the light emitting device via scan-power electrode. This embodiment provides an n-channel drive, common cathode structure. However, the data voltage that is written in the capacitor 804, and that controls the gate of drive transistor 801, always includes an operating voltage from the light emitting diode 805. The trade-offs in this embodiment are therefore a) the data voltage needs to be raised by an offset voltage approximately equal to the average turn-on voltage of the OLED 805 to ensure transistor 801 is properly turned on and in its saturation region, b) an added diode, and c) inclusion of OLED voltage in the data voltage for controlling the gate of drive transistor 801.

It should be noted that the circuit in FIG. 8 operates equally well when OLED 805 is replaced by a bi-directional light emitting device that conducts current in both directions. The operation of this circuit gives an example of a further application within the scope of the present invention.

Figure 9:
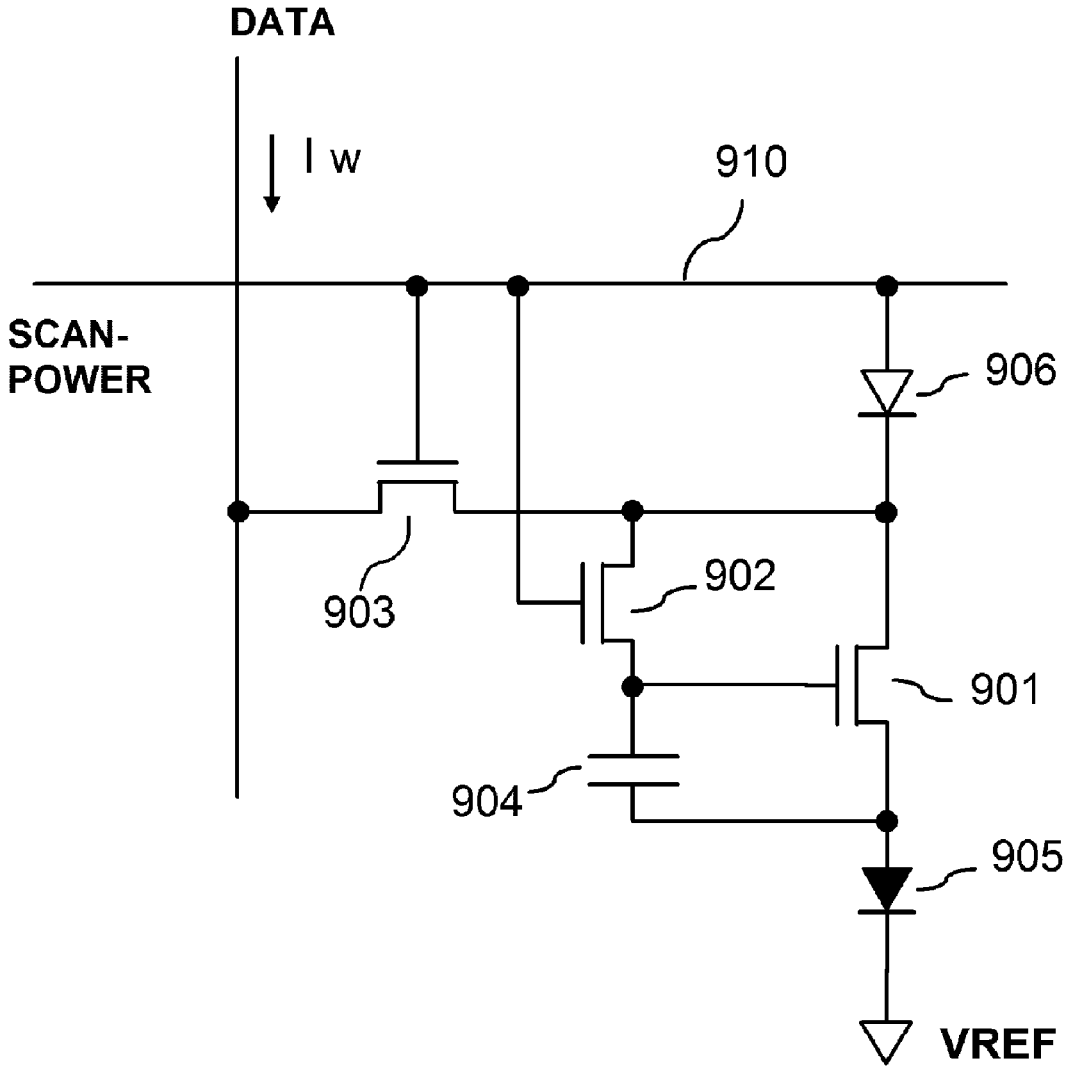
FIG. 9 is a schematic diagram of a pixel circuit in an alternate embodiment of the present invention.

An embodiment improves upon FIG. 8 is given in FIG. 9. A preferred implementation of FIG. 9 has two p-channel transistors 903 and 902, an n-channel transistor 901, a capacitor 904, a diode 906, and OLED 905. Referring to FIG. 9, the second terminal of storage capacitor 904 is connected to the source terminal of transistor 901, thereby eliminating the dependency on OLED, and providing a current drive with n-channel drive transistor in common-cathode mode. An additional benefit of this embodiment is that the OLED 905 continues to output light during scan cycle according to the data current, and almost uninterrupted. The data current is also directed for light output, and thus resulting in improved power efficiency.

The scanning cycle of embodiment FIG. 9 is initiated by applying a voltage low on a scan-power electrode 910, turning on the two p-channel transistors 903 and 902, eliminating the power source of OLED from scan-power electrode, and putting diode 906 in reverse. A preferred level of voltage low for scanning cycle is equal to or slightly negative than VREF, as discussed before for FIG. 6. As transistor 902 is turned on, the potential at the gate of n-channel transistor 901 and at the first terminal of capacitor 904 is the same as the potential at the drain of 901, or $V_{DS}=V_{GS}$, forcing 901 to the onset its saturation region as did in the circuit of FIG. 6. The relations (1), (2), (3), and (4) above are therefore valid here following the same derivation as before. The output current on OLED 905 in drive cycle is therefore equal to the input data signal $I_W$.

FIG. 9 provides an n-channel drive, common-cathode structure. The trade-off is an added diode. In addition, the embodiment of FIG. 9 requires a higher operating data voltage range for setting the data state of the pixel. A voltage offset is needed to compensate the required increase of total data voltage due to the inclusion of forward voltage drop of 905 as data current passes through OLED 905 in a scanning cycle, and to ensure the proper voltage writing on capacitor 904 and the gate of transistor 901. A variation of from FIG. 9 may be derived by replacing 901 with a P-channel transistor, 902 and 903 with n-channel transistors, and reverse the polarities of the diodes, data current, and voltage VREF.

Figure 10:
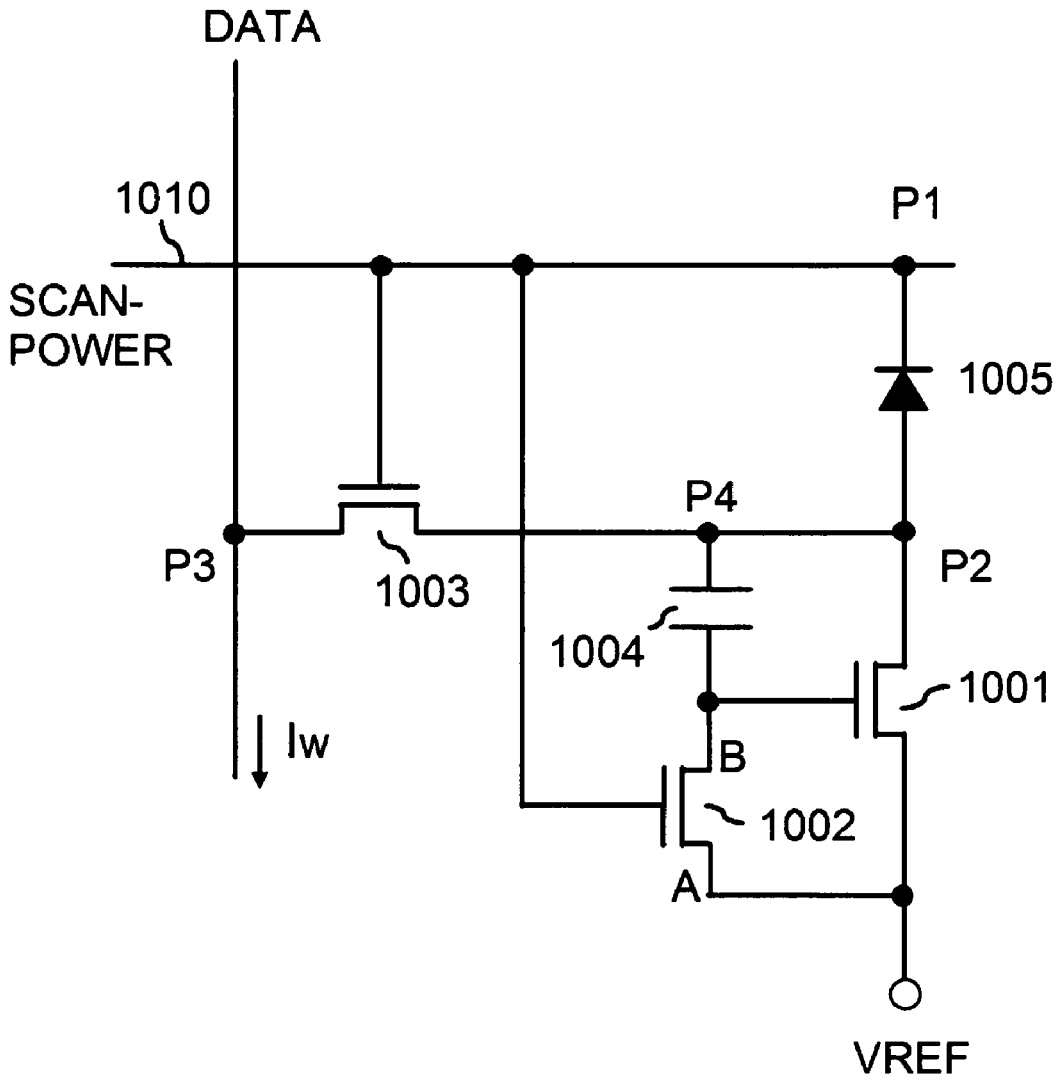
FIG. 10 is a schematic diagram of a pixel circuit in a preferred embodiment of the present invention.

Another embodiment of the present invention is provided in FIG. 10, wherein a pixel circuit comprises three N-channel transistors 1001, 1002, and 1003. The pixel circuit comprises a first conducting channel from data electrode to VREF, and a second conducting channel from the scan-power electrode to VREF via a light emitting element 1005. In a preferred mode of operation similar to that discussed in the operation of FIG. 6, VREF is set to be higher than the data voltage range, and a data current is drawn from VREF to a data electrode. The scan-power electrode carrying a scanning signal $V_{HI}$ that is equal to or slightly higher than VREF in a scanning period, turning on transistor 1002 and 1003, allowing a data current flow between the data electrode and VREF, and setting the voltage at the gate of transistor 1001 voltage the same as its drain voltage. A data voltage is generated from the data current conducted through transistor 1001 in its saturation mode, setting the voltage of the capacitor 1004. In a drive cycle, this data voltage is the VGS controlling the current flow via drive transistor 1001 in the saturation mode in a similar manner as that discussed for circuit operation of FIG. 6.

Figure 11:
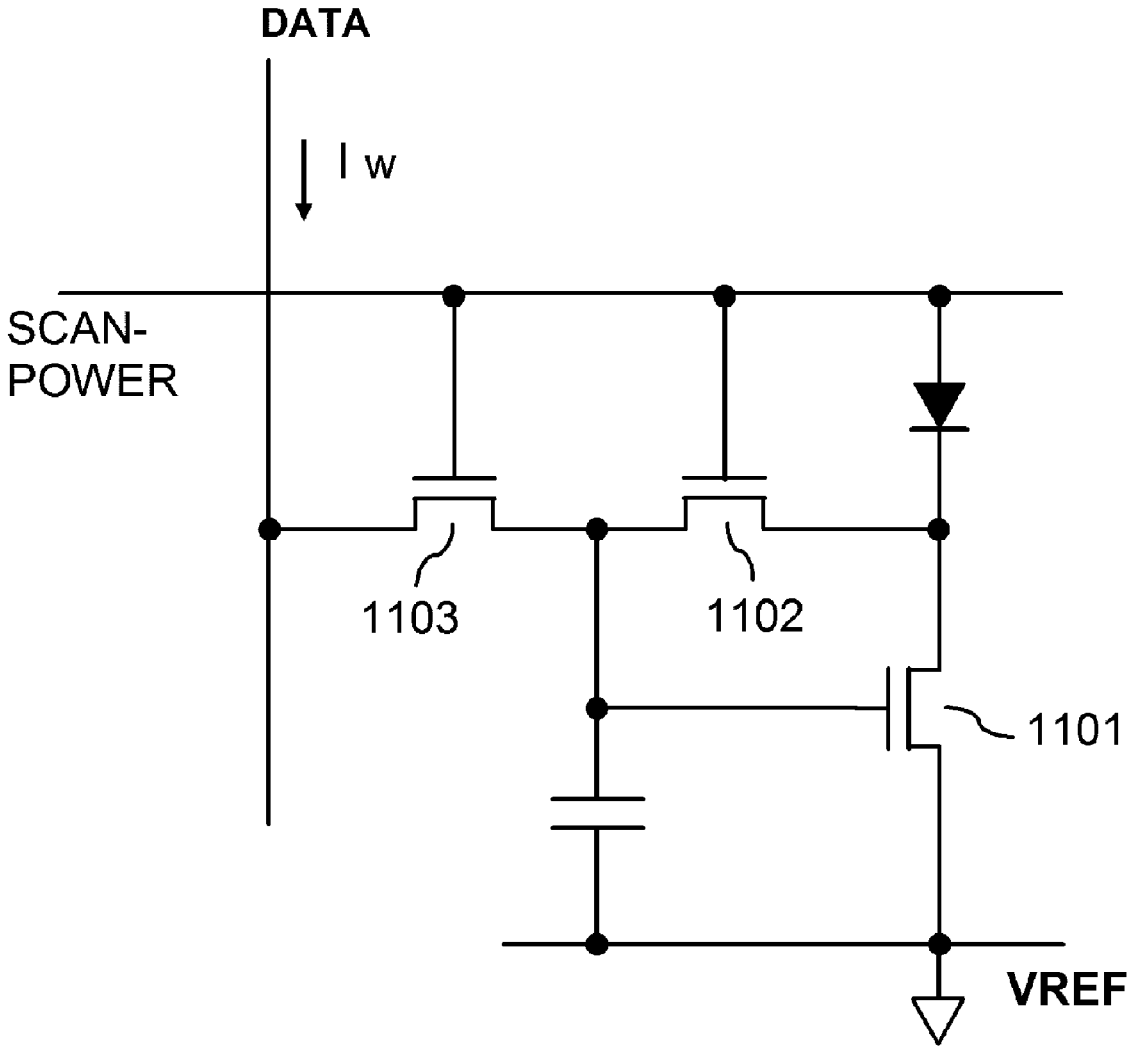
FIG. 11 is a schematic diagram of a pixel circuit in an alternate embodiment of the present invention.

An embodiment in FIG. 11 illustrates a pixel circuit of this invention operating in the linear region of the drive transistor 1101. In a preferred operation, the two p-channel transistors 1103 and 1102 are turned on by applying a voltage low on a scan-power electrode. This allows a data current to be directed to the voltage source VREF via transistor 1101, 1102, and 1103. Both transistors 1101 and 1102 are thus in their linear operating regions since $V_{DS}$ is less than $V_{GS}$ for both transistors. The voltage at the gate of 1101, which is the voltage to be stored at the capacitor 1104, is transferred from the drain of 1101 via 1102. If a shift in threshold voltage causes 1101 to have a higher $V_T$, the voltage at the drain of 1101 is also shifted higher; this moves the $V_{GS}$ of 1101 higher, and partially offset the $V_T$ variation. In a drive period, the voltage of the scan-power electrode is set high, turning off both transistors 1102 and 1103, and isolating capacitor 1104. The circuit of FIG. 11 thus comprises two alternating conducting channels, a first conducting channel from data electrode to VREF, a second conducting channel from scan-power electrode to VREF via the light emitting element 1105, one of which is enabled while the other is inhibited by the scan-power electrode carrying a scan signal or a drive signal.

Figure 3:
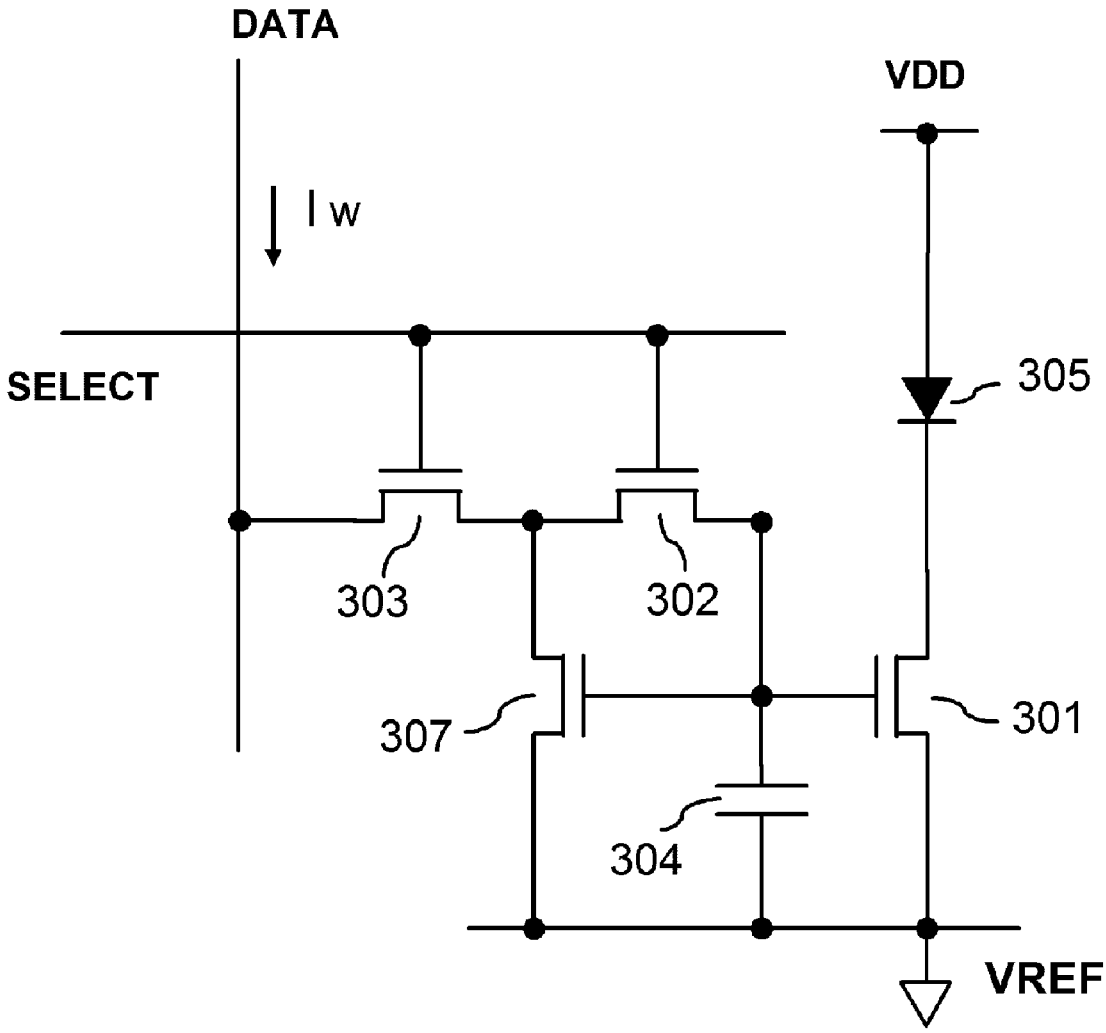
Fig. 3 (Prior Art)
FIG. 3 is a schematic of a prior art pixel circuit in an active matrix light emitting device.
Figure 4:
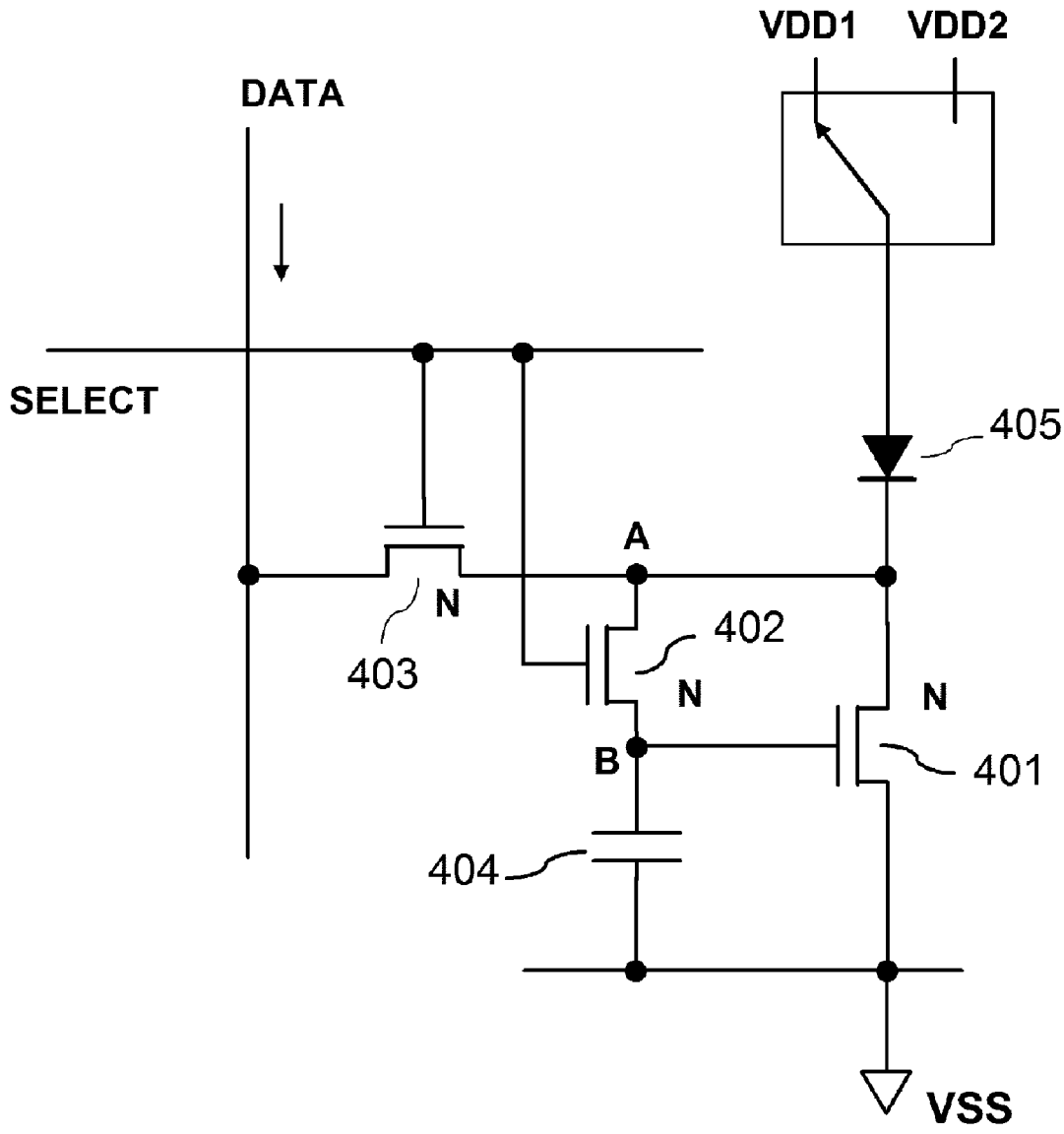
Fig. 4 (Prior Art)
FIG. 4 is a schematic of a prior art pixel circuit in an active matrix light emitting device.
Figure 5:
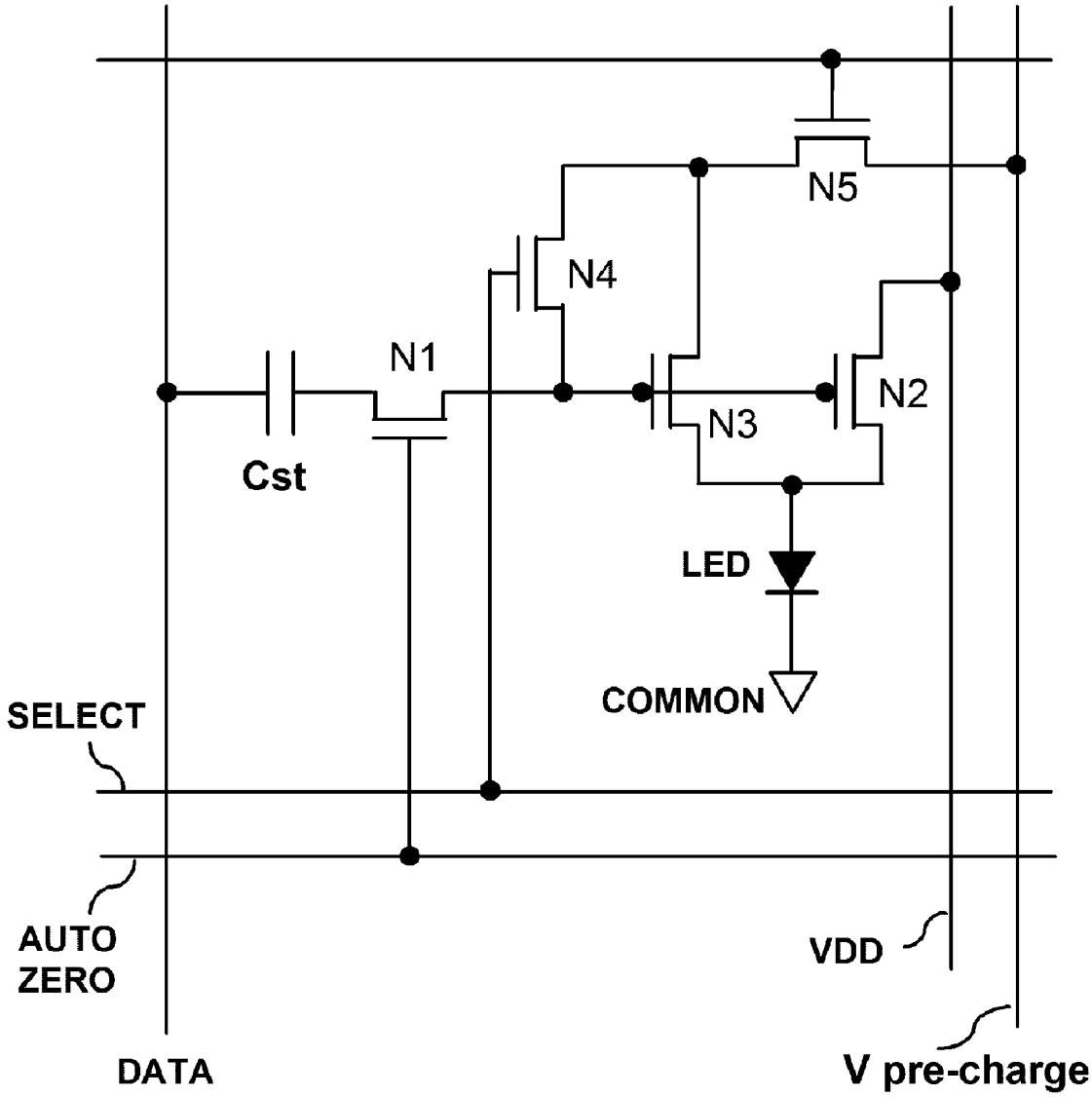
Fig. 5 (Prior Art)
FIG. 5 is a schematic of a prior art pixel circuit in an active matrix light emitting device.

The preferred embodiments of FIG. 6 and FIGS. 7, and 10, and the preferred operations thereof, achieved a similar pixel-independent current drive scheme as proposed by the prior art of FIG. 3 to FIG. 5, with three switching elements in a pixel. The structures and operation in the present invention do not make reliance on additional external switching or power electrode. Further extensions of the present invention may be obtained by altering pixel bias direction, wiring, or combining with adjacent pixels. The following embodiments provide more examples of variation.

Figure 12:
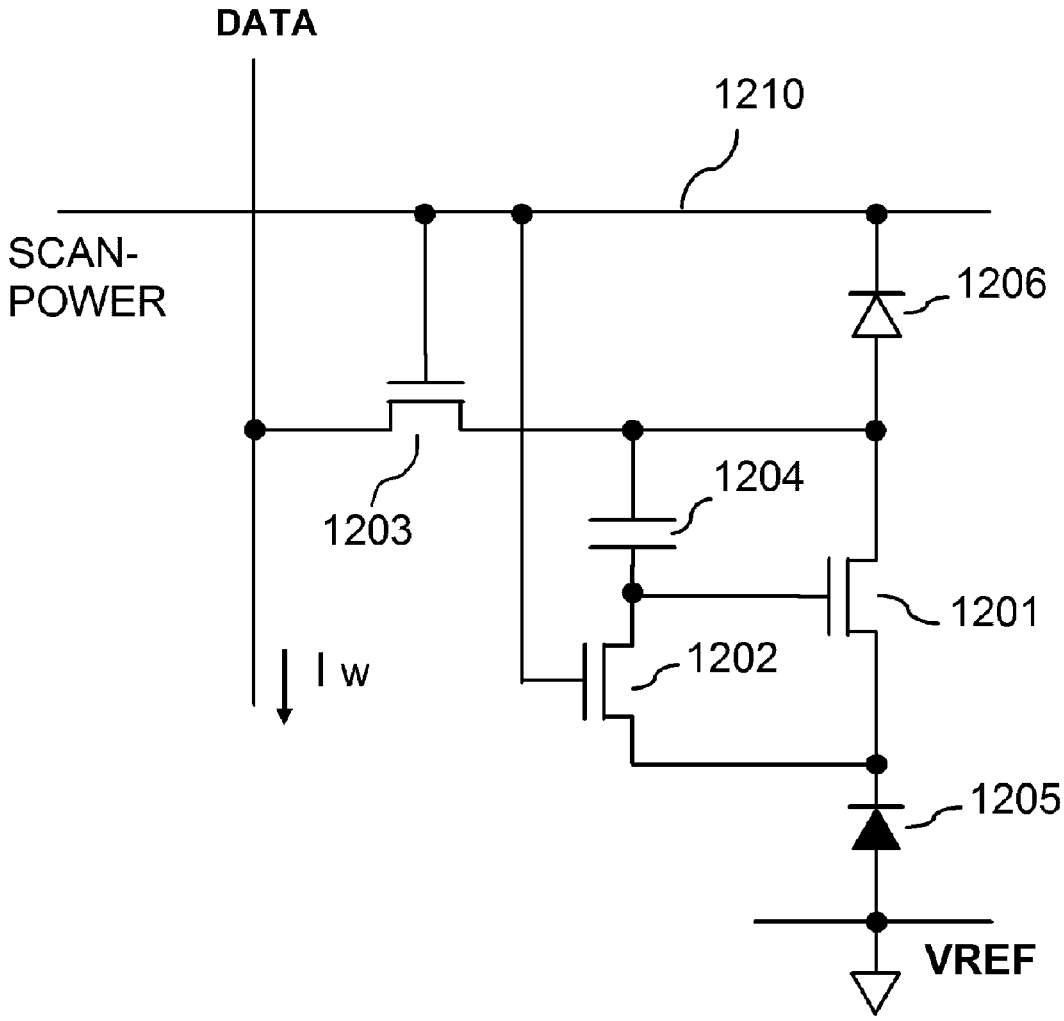
FIG. 12 is a schematic diagram of a pixel circuit in an alternate embodiment of the present invention.

The pixel circuit of FIG. 12 comprises three n-channel transistors 1203, 1202, and 1201, a storage capacitor 1204, an OLED 1205, a diode 1206, and a reference voltage VREF. The preferred operation and the setting of VREF are similar to that of embodiments in FIG. 6, FIG. 7, and FIG. 9. In a scanning cycle, a voltage high is applied on a scan-power electrode 1210, turning on transistor 1202 and 1203; in a drive cycle, a voltage low is applied. Following a similar operation analysis, it can be verified that pixel circuit in FIG. 12 provides the same current drive control as for circuits in FIG. 9, and delivers a drive current in drive cycle equal to the current of input data signal. Furthermore, with the implementation of a diode 1206 in the circuit, the operation of voltage setting does not rely on the polarity of the light emitting device 1205. This circuit thus operates equally well for a light emitting diode and for a bio directional light emitting device placed at 1205. A p-channel version of FIG. 12 is obtained by replacing all three transistors 1201, 1202 and 1203 by p-channel transistors, reversing the polarity of the diodes, the direction of data current, and the operating voltages high and low. Both of these pixel circuits include an additional diode to limit the reverse bias leakage current, and to allow the light emitting device to be either a diode or a bi-directional device. The preferred operations of these embodiments are parallel to that for the embodiments of FIGS. 6, 9, and 10. Those skilled in the art will quickly find analogy from the descriptions for those embodiments hereinabove.

Noted here is that the circuits of FIGS. 6 and 10 operate on three transistors while relying on the diode property of the light emitting device, the circuits of FIGS. 8, 9 and 12 operate on three transistors and an additional diode. The addition of a diode allows the circuit operation to decouple from the reliance on the diode property of the light emitting element, thus allowing a more independent circuit control and a broader application for a bi-directional light emitting device.

Regarding the efficiency in light emitting area (aperture ratio), a favorable embodiment of storage capacitor in a pixel circuit is a capacitor formed with the scan-power electrode conductor as part of the capacitor structure. A typical example of this is a capacitor formed underneath a scan-power electrode along one side of a pixel, having a thin layer of dielectric material formed between the scan-power electrode and another conductive layer underneath. In such embodiments, one capacitor terminal is connected to an adjacent scan-power electrode. An embodiment of a pixel circuit having such a capacitor structure is provided in FIG. 13, wherein a pixel circuit comprises transistors 1301, 1302 and 1303, capacitor 1304, and OLED 1305, and wherein the capacitor 1304 in a pixel driven by the $n^{TH}$ scan-power electrode is connected to the $(n-1)^{th}$ scan-power electrode. This pixel circuit is a direct extension of the pixel circuit in FIG. 6, and operates on the same principle and procedure as for the circuit of FIG. 6, except that the capacitor voltage references to the high side voltage of an adjacent scan-power electrode that fluctuates momentarily to a voltage low during the scanning cycle of the adjacent row. The scanning pulses are applied to the scan-power electrodes sequentially to set the data voltage in each row of pixels.

Figure 14:
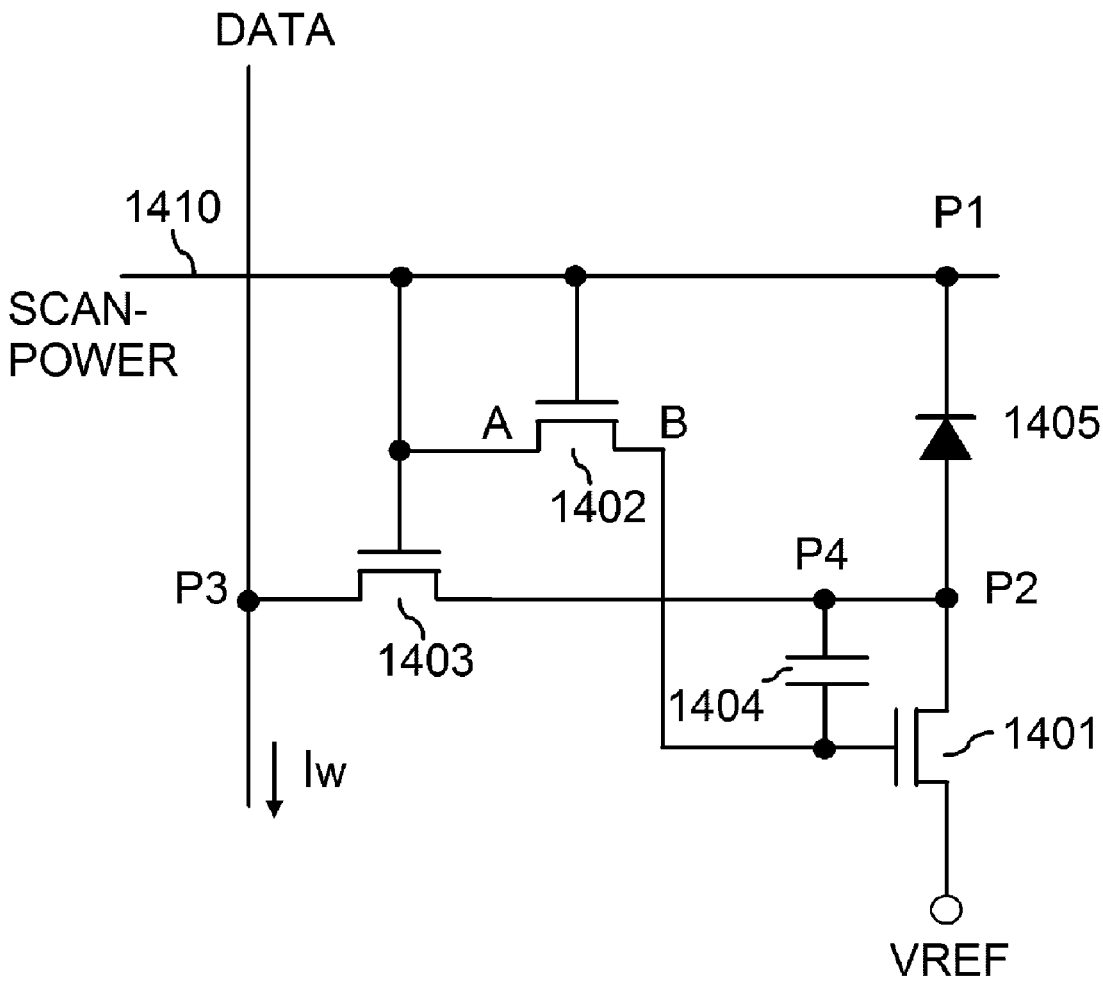
FIG. 14 is a schematic diagram of a pixel circuit in a preferred embodiment of the present invention.

To further illustrate the application of the present invention, another preferred embodiment is provided in FIG. 14. This embodiment is configured to make the gate voltage of transistor 1401 track the scan-power electrode during a scanning period. If, in a preferred mode of operation, the scanning voltage is set to be the same as VREF or slightly higher, n-channel transistor 1402 is turned on and biased into its saturation region in a scanning period when a scanning voltage $V_{HI}$ is applied to the scan-power electrode 1410. The gate of transistor 1401 is thus brought to the same level as VREF in a scanning period, and the subsequent operation of this circuit becomes parallel to that of the circuit and operation of FIG. 10. This embodiment, however, allows the gate voltage of transistor 1401 to be set at any selected offset point, and allows additional adjustment on offset voltage through the adjustment of the scanning voltage. In a preferred embodiment, all transistors are n-channel transistors. The pixel provides a first conducting channel from the data electrode to VREF during a scanning period when all the n-channel transistor 1401, 1402 and 1403 are turned on by a $V_{HI}$ on the scan-power electrode, and a second conducting channel from VREF to the scan-power electrode during a drive period when transistor 1401 becomes forward biased and remains on according to a positive data voltage on its gate. The first conducting channel is turned off during a drive period as transistors 1402 and 1403 being turned of by a voltage $V_{LO}$ on the scan-power electrode.

Figure 13:
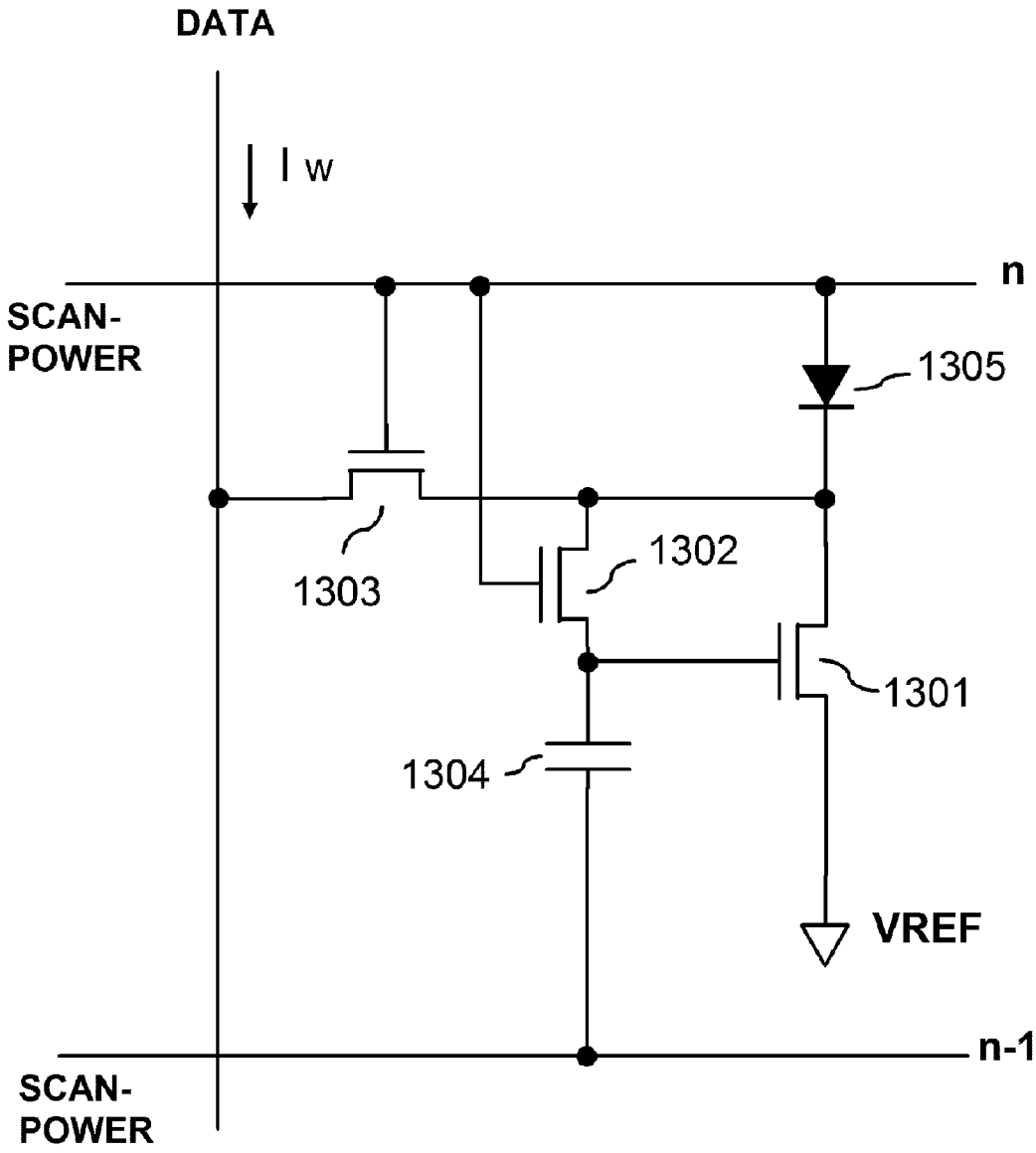
FIG. 13 is a schematic diagram of a pixel circuit in an alternate embodiment of the present invention.

The present invention is described herein with specific combinations of transistors and polarity of OLED in each embodiment. These embodiments illustrate a drive scheme and rules to implement pixels circuit within such scheme. Variances and extensions are expected to be derived from these embodiments, but still within the scope of the present invention. For example, an implementation using four transistors in a pixel utilizing the method of delivering drive current to a light emitting element and performing scan selection with the same access electrodes, wherein setting the gate voltage through a current source and directed through a current path connecting the data electrode and the voltage source, or convert to data voltage from the drive transistor in its saturation region and achieving a pixel independent current control as discussed in this invention, will fall well within the scope of the present invention. It is also well recognized by those skilled in the art that circuit operations in embodiments of FIGS. 8, 9 and 12 do not require a reliance on the property of light emitting element being a diode. For example, these circuits perform equally well and achieve the same merit discussed therein when the OLED is replaced by a bi-directional light emitting device. Furthermore, the storage capacitor in the embodiments of FIGS. 6, 7, 9, 11 may be constructed similarly by coupling to an adjacent scan-power electrode as illustrated in FIG. 13.

Although various embodiments utilizing the principles of the present invention have been shown and described in detail herein, and various preferred modes of operation are provided, those skilled in the art can readily devise many other variances, modifications, and extensions that still incorporate the principles disclosed in the present invention. The scope of the present invention embraces all such variances, and shall not be construed as limited by the number of active elements, wiring options of such, or the polarity of a light emitting device therein.

What is claimed is:

1. A display comprising at least:

a data electrode for delivering input data;

a scan-power electrode; said scan-power electrode delivering at least a first signal and a second signal in operating said display;

a reference voltage source;

a pixel disposed at the intersect of said scan-power electrode and said data electrode;

said pixel comprising:

a light emitting element; said light emitting element emits light according to an electrical current supplied thereto;

a storage element for holding data information, having a first and a second ends;

a control circuit for regulating a drive current directed to said light emitting element according to said data information, and for controlling data input from said data electrode;

wherein said storage element is connected to said control circuit;

wherein said scan-power electrode controls data input to said pixel by carrying at least a first and a second signals; wherein by carrying said first signal, said control circuit allows a data information to be received at said storage element from said data electrode; wherein by carrying said second signal, said control circuit inhibits the influence from said data electrode on said storage element, and retains said data information held at said storage element;

Wherein said control circuit further comprises:

a first conducting channel for conducting electrical current between said data electrode and said reference voltage source via said control circuit;

a second conducting channel for directing an electrical current from said scan-power electrode to said reference voltage source via said control circuit and said light emitting element;

wherein said first conducting channel, when enabled, provides a first direct current path connecting said data electrode and said reference voltage source via said control circuit; wherein said first conducting channel, when enabled, sets a voltage at said storage element corresponding to said data information;

wherein said second conducting channel, when enabled, provides a second direct current path connecting said scan-power electrode and said reference voltage source via said control circuit and said light emitting element; wherein said second conducting channel, when enabled, directs a drive current to said light emitting element according to said data information in said storage element.

2. The display according to claim 1, wherein the enabling of said first conducting channel disables said second conducting channel, and wherein the disabling of said first conducting channel enables said second conducting channel.

3. The display according to claim 1, wherein said control circuit comprises a first active element in said second conducting channel, said first active element having a control gate, and a channel between a second and a third terminals; wherein said first active element forms part of said second direct current path via said second and third terminals; wherein said first active element regulates a drive current directed to said light emitting element through said second conducting channel, according to a data voltage held at said storage element;

wherein said first active element forms part of said first conducting channel via said second and third terminals of said first active element.

4. The display according to claim 1, wherein said control circuit comprises a first active element in said second conducting channel, said first active element having a control gate, and a channel between a second and a third terminals; wherein said first active element forms part of said second direct current path via said second and third terminals; wherein said first active element regulates a drive current directed to said light emitting element through said second conducting channel, according to a data voltage held at said storage element;

wherein said storage element is connected to said gate of said first active element;

wherein said control circuit converts a data current directed along said first conducting channel to a data voltage, and provides such data voltage at said storage element and at the control gate terminal of said first active element.

5. The display according to claim 1, wherein said control circuit comprises a drive transistor for regulating a drive current directed to said light emitting element, and wherein said first end of said storage element is connected to the gate of said drive transistor; the voltage at the gate of said drive transistor is brought to the same voltage at the drain of said drive transistor by applying said first signal to said scan-power electrode.

6. The display according to claim 1, wherein said control circuit comprises a drive transistor for regulating a drive current directed to said light emitting element, and wherein said first end of said storage element is connected to the gate of said drive transistor; the voltage at the gate of said drive transistor is brought to the same as the voltage of the scan-power electrode by applying said first signal to said scan-power electrode.

7. The display according to claim 1, wherein said control circuit comprises a drive transistor for regulating a drive current directed to said light emitting element, and wherein said first end of said storage element is connected to the gate of said drive transistor;

wherein said drive transistor further operates as a conversion transistor in a data input period during which said first signal is applied to said scan-power electrode; wherein said conversion transistor converts a data current directed from said data electrode to said pixel during a data input period into a data voltage at the gate of said conversion transistor.

8. The display according to claim 1, wherein said second conducting channel, when enabled, provides entire drive current required for drive said light emitting element according to said data information.

9. The display according to claim 1, wherein said storage element is a capacitor; said capacitor being one, or a combination of: capacitor formed with an insulator between two conductive layers in parallel, parasitic capacitor in a transistor, inherent capacitor of a diode.

10. The display according to claim 1 further comprises a plurality of said data electrode, a plurality of scan-power electrode, a plurality of said pixel disposed at the intersects of the data electrodes and the scan-power electrodes; a data driving circuit; a scan-power driving circuit; each said control circuit in each said pixels comprises, an active element for regulating said drive current, and an active element for controlling data input from said data electrodes; wherein said data driving circuit comprises at least a number of output terminals matching the number of said data electrodes; each output terminal being connected to a said data electrode;

wherein said scan-power driving circuit comprises at least a number of output terminals matching the number of said scan-power electrodes; each said output terminals being connected to a said scan-power electrodes;

said data driving circuit delivering input data signals in the form of current levels at said output terminals to said data electrodes;

said scan-power driving circuit delivering a scanning voltage in an operating period to turn on the gates of active elements connected to said scan-power electrode to enable data input;

said scan-power driving circuit delivering a drive voltage in the other period of operating said display to turn off all selecting transistors connected to said scan-power electrode; said drive voltage delivering drive current to the light emitting elements in all pixels connected to said scan-power electrode according to respective data information in said pixels;

wherein said scanning voltage and said drive voltage generated by said scan-power driving circuit differ by at least a voltage difference between turning on and off of a transistor.

11. The display according to claim 1, wherein said enabling and disabling of said conducting channels are controlled by said scan-power electrode.

12. The display according to claim 11, wherein said scan-power electrode carrying a first signal enables said first conducting channel and disable said second conducting channel; wherein said scan-power electrode carrying a second signal voltage enables said second conducting channel and disables said first conducting channel; wherein said first signal voltage and said signal voltage are different by at least a voltage difference between turning on and off of a transistor.

13. The display according to claim 1, wherein applying said second signal to said scan-power electrode enables said second conducting channel, therein directing a current to said light emitting element via said scan-power electrode.

14. The display according to claim 13, wherein said applying said second signal to said scan-power electrode inhibits said first conducting channel.

15. The display according to claim 1, wherein applying said first signal to said scan-power electrode enables said first conducting channel, thereby allowing a data current from said data electrode to said reference voltage source via said control circuit.

16. The display according to claim 15, wherein said applying said first signal to said scan-power electrode inhibits said second conducting channel.

17. The display according to claim 15, wherein said control circuit further comprises a switching element for controlling the current in said second conducting channel; said switching element having a gate, a second and a third terminal; said control circuit converts said data current to a data voltage at the gate of said switching element.

18. The display according to claim 15, wherein said first conducting channel, when enabled, converts said data current to a data voltage at the two ends of said storage element; wherein said conversion sets the voltage on said storage element according to said data current.

19. The display according to claim 18, wherein said first conducting channel comprises a first active element having a gate terminal, a second terminal and a third terminal; wherein said first end of said storage element is connected to said gate;

wherein said active element converts said data current to a data voltage between said gate and said second terminal of said active element; wherein said data voltage is provided for said storage element to store.

20. The display according to claim 1, wherein said storage element is a capacitor;

wherein said control circuit comprises:

a first transistor having a gate terminal, and a channel between a second terminal and a third terminal; wherein said channel of said first transistor constitutes a part of both said first conducting channel and said second conducting channel;

a second transistor having a gate terminal, and a channel between a second terminal and a third terminal; wherein said gate of said second transistor is connected to a scan-power electrode, and wherein said channel of said second transistor constitutes a part of said first conducting channel;

wherein said capacitor is connected to said gate of said first transistor.

21. The display according to claim 20 wherein said light emitting element is an organic light emitting device.

22. The display according to claim 20, wherein said control circuit further comprises a third transistor having a gate, a second terminal and a third terminal;

wherein said gate of said third transistor is connected to a scan-power electrode; and wherein said second terminal of said third transistor is connected to said gate of said first transistor.

23. The display according to claim 22, wherein said first transistor controls a drive current directed to said light emitting element during a drive period when said second signal is applied to said scan-power electrode;

wherein said first transistor converts said data current to a data voltage between the gate and the source of said first transistor in a scanning period during which said first signal is applied to said scan-power electrode; wherein all said transistors are n-channel transistors.

24. A method for operating a display, said display comprising:

a data electrode for delivering input data;

a scan-power electrode; said scan-power electrode delivering at least a first signal and a second signal in operating said display;

a reference voltage source;

a pixel disposed at the intersect of said scan-power electrode and said data electrode;

said pixel comprising:

a light emitting element; said light emitting element emits light according to an electrical current supplied thereto;

a storage element for holding data information, having a first and a second ends;

a control circuit for regulating a current directed to said light emitting element according to said data information;

wherein said storage element is connected to said control circuit;

wherein said scan-power electrode controls data input to said pixel by carrying at least a first and a second signals; wherein by carrying said first signal, said control circuit allows a data information to be received at said storage element from said data electrode; wherein by carrying a second signal, said control circuit inhibits the influence from said data electrode on said storage element, and retains said data information held at said storage element;

wherein said method comprising the following steps:

applying a first signal to said scan-power electrode to select said pixel for data input in a data writing period;

same said first signal enabling a first conducting channel between said data electrode to said reference voltage source; by enabling said conducting channel, a direct current path being provided to allow a data current to be conducted from said data electrode to said reference voltage source;

applying a second signal to said scan-power electrode to enable a second conducting channel between said scan-power electrode and said reference voltage source;

said first signal inhibiting said second conducting channel;

said second signal inhibiting said first conducting channel.

25. The method according to claim 24, wherein said first signal causes a data voltage to be generated at the two ends of said storage element.

26. The method according to claim 24, wherein said control circuit comprises a first transistor, wherein the drain to source channel of said first transistor is part of said first conducting channel;

wherein said applying said first signal to said scan-power electrode brought the gate of said first transistor to the same voltage as the drain of said first transistor.

27. The method according to claim 24, wherein said control circuit comprises a first transistor; wherein the drain to source channel of said first transistor is part of said first conducting channel;

wherein said applying said first signal to said scan-power electrode brought the gate of said first transistor to the same voltage as that of said scan-power electrode.

28. The method according to claim 24, wherein each of said input data is delivered via said data electrode in the form of a current.

* * * * *